US011607573B2

(12) United States Patent
Hunt

(10) Patent No.: US 11,607,573 B2
(45) Date of Patent: Mar. 21, 2023

(54) JUMP ROPE DEVICE WITH REMOVABLY-CONNECTED CABLE AND IMPROVED BEARING ASSEMBLY THEREFOR

(71) Applicant: Crossrope, LLC, Raleigh, NC (US)

(72) Inventor: David Hunt, Raleigh, NC (US)

( * ) Notice: Subject to any disclaimer, the term of this patent is extended or adjusted under 35 U.S.C. 154(b) by 0 days.

(21) Appl. No.: 17/532,091

(22) Filed: Nov. 22, 2021

(65) Prior Publication Data

US 2022/0161085 A1 May 26, 2022

Related U.S. Application Data

(60) Provisional application No. 63/117,583, filed on Nov. 24, 2020.

(51) Int. Cl.
*A63B 5/20* (2006.01)

(52) U.S. Cl.
CPC ..... *A63B 5/20* (2013.01)

(58) Field of Classification Search
CPC ... A63B 5/20; A63B 21/072; A63B 21/00061; A63B 21/0557; A63B 21/00069; A63B 23/03533; A63B 21/0555; A63B 21/4035; A63B 21/00043; A63B 21/4043; A63B 23/1209; A63B 2023/006; A63B 2225/09
See application file for complete search history.

(56) References Cited

U.S. PATENT DOCUMENTS 4,637,606 A * 1/1987 Hunn ..... A63B 5/20 482/82
4,787,624 A * 11/1988 Grant ..... A63B 5/20 482/82
5,478,297 A * 12/1995 Dennis, Jr. ..... A63B 5/20 482/81
6,752,746 B1 * 6/2004 Winkler ..... A63B 5/20 482/126
8,088,047 B2 * 1/2012 Marji ..... A63B 5/20 482/82
8,911,333 B2 * 12/2014 Hunt ..... A63B 5/20 482/81
10,478,655 B2 * 11/2019 Hunt ..... A63B 5/20
2006/0094573 A1 * 5/2006 Week ..... A63B 21/0552 482/121
2013/0165299 A1 * 6/2013 Hunt ..... A63B 5/20 482/82
2014/0228180 A1 * 8/2014 Walker ..... A63B 21/0557 482/82
2014/0243164 A1 * 8/2014 Suplee ..... A63B 5/20 482/82
2015/0119206 A1 * 4/2015 Newman ..... A63B 5/20 482/82
2016/0067536 A1 * 3/2016 Carpinelli ..... A63B 5/20 482/82
2018/0361187 A1 * 12/2018 Hopkins ..... A63B 5/20
(Continued)

*Primary Examiner* — Garrett K Atkinson

(57) ABSTRACT

A jump rope device includes a handle and a cable detachably connected to one another via a first and second connecting members. The handle includes a bearing assembly that is connected to the first connecting member via a connecting ring. A bearing post of the bearing assembly includes an enlarged portion that limits the range of motion of the bearing ring so as to prevent the first connecting member from making any contact with any portion of the handle other than the connecting ring.

3 Claims, 23 Drawing Sheets

(56) References Cited

U.S. PATENT DOCUMENTS

| | | | | |
|---|---|---|---|---|
| 2019/0118019 | A1* | 4/2019 | Hunt | A63B 5/20 |
| 2019/0321672 | A1* | 10/2019 | Gagne | A63B 5/20 |
| 2020/0030653 | A1* | 1/2020 | Hunt | A63B 5/20 |

* cited by examiner

JUMP ROPE DEVICE WITH REMOVABLY-CONNECTED CABLE AND IMPROVED BEARING ASSEMBLY THEREFOR

REFERENCE TO RELATED APPLICATION

This application claims the benefit of priority under 35 U.S.C. § 119(e) of U.S. provisional application Ser. No. 63/117,583 filed on Nov. 24, 2020, which is hereby incorporated by reference in its entirety.

FIELD OF THE DISCLOSURE

The present disclosure relates to exercise equipment and more particularly to jump rope devices.

BACKGROUND

Jumping rope has been a popular children's activity since the Middle Ages. Since the 1970's, it has come into the mainstream as a staple of many of the most popular exercise regimes.

Jumping rope has long been a popular exercise due to its health benefits in aerobic and anaerobic training, as well as the enjoyment in performing fun, challenging, and dynamic variety of skills. Jump rope routines may condition multiple muscle groups simultaneously via a natural, full-body motion.

Jump rope routines have a short learning curve because jumping rope leverages natural body motions. This gentle learning curve makes jumping rope accessible to easily discouraged novices, increasing the chances that a new jump roper will stick with a jump-rope-based workout regime. This may provide an opportunity to offer additional jump rope-based products to a jump rope user as they progress such as additional workout videos, new jump ropes and the like.

Jumping rope has become an increasingly popular cross-training exercise because of recent fitness trends that indicate a preference for exercises that offer functional, full-body motions that condition several muscles and train several skills in a natural body motion. Jump ropes are uniquely suited to cross-training exercise regimes because the user may vary the resistive forces of the jump rope in a variety of ways. For example, the centripetal force exerted by a jump rope as it is being rotated is proportional to the mass of the jump rope. Thus, if the mass of the jump rope is doubled, a jump roper must work about twice as hard to spin the rope at the same speed. The centripetal force exerted by a jump rope as it is being rotated is proportional to the square of the rope's angular velocity. Thus, if the jump rope spins twice as fast, a jump roper must work four times as hard to counteract the centripetal force exerted by the spinning jump rope.

This unique combination of resistive forces (i.e. centripetal force due to jump rope mass and configuration and centripetal force due to jump rope speed) enables anaerobic and aerobic exercise using the same equipment, during the same exercise routine. The availability of strength training and cardiovascular workouts from a single piece of exercise equipment greatly increases the utility of the equipment to the user. It reduces the equipment needed to successfully exercise. Additionally, user familiarity and comfort with the jump rope is increased because the user spends a significant amount of time with the jump rope instead of dividing time between multiple exercise apparatuses.

If a jump rope of appropriate size and weight is provided, jumping rope enables the user to target specific muscle groups and to develop fast twitch muscle or slow twitch muscle. For example, thin and light jump ropes enable the user to focus on cardiovascular fitness. This may tone the users muscles and reduce fat. Heavier ropes may be utilized by users wishing to improve muscle tone and bulk in their forearms, biceps, and shoulders.

Specialized workouts may be used in conjunction with specifically chosen jump ropes in order to target certain muscle groups during exercise. High knee jumping with a heavy jump rope, for example, may target the user's arms and core muscles. Single- and double-leg high knee exercises may greatly increase fast twitch leg muscles. Over time this may enable high power output in the user's legs. Side rope swings may isolate and improve the fitness of the user's arms when consistently added to a workout routine.

While a jump rope's resistance may be varied during a workout (thereby transitioning between anaerobic and aerobic exercise), and different jump rope-based workout routines may be used to target certain muscle groups, further enhancing the flexibility and utility of a jump rope is desirable. One method of providing enhancements is providing a jump rope with adjustable features such as adjustable or interchangeable physical characteristics.

There are several known examples of jump ropes that have adjustable features. However, the effectiveness, ease of adjustment, and scope of scalability of these adjustments has not been fully realized. Jump rope handles have been disclosed which are capable of simultaneously connecting multiple ropes. However, this design results in handles that are awkward to hold and make jumping rope more difficult because of the number of ropes that have to pass beneath a jumper's feet and that could get caught.

In order to improve the functionality of a jump rope, some jump ropes, such as those disclosed in U.S. Pat. No. 4,101,123 to Anthony, contain a ball bearing embedded in the handle that can be removed. However, this design limits the potential weight of the rope because excessive centrifugal force while jumping rope could unexpectedly dislodge the ball bearing from the rope.

The functionality of a jump rope may be expanded by altering the physical characteristics of the rope itself. For example, U.S. Pat. No. 4,109,906 to Wilson discloses a jump rope that allows interchanging of a stiff bottom center section of the rope in order to widen and flatten the base over which the jumper jumps in an effort decrease the necessary skill or ability required to perform the jump roping action. The interchanging center section allows the user to vary the resistance by selecting a section that varies in weight and stiffness. However, this is an ineffective method to vary resistance due to the awkward shape of the rope structure where one end of the center section can hit the ground before the other end does. This results in the rope bouncing up to hit the jumper's foot or leg. Additionally, this rope shape does not give the jumper the ability to perform any arm crossing or side-to-side rope jumping skills because the center section obstructs the performance of these types of motion.

U.S. Pat. No. 4,177,985 to Hlasnicek also discloses a jump rope with variable weight configurations. The handles have overlapping plastic sleeves that may remain on the handles for the lighter of the rope weight configurations or the user may slide the sleeves down to the center of the rope to overlap the existing plastic segments resulting in a slightly higher rope weight and resulting resistance. However, this design limits the variety and variability of weighted configurations and the composite jump rope weight does not change, just the positioning of the weight. Exclusion of a means to alter the mass of the jump rope limits the functionality and versatility of the jump rope.

Some jump rope devices disclose methods of adding mass to the jump rope, such as utilizing a hollow tube as the rope portion of the jump rope device and then filling the tube with a material such as sand or water. Although this provides a method of increasing the mass of the rope, such designs bend easily and in an unpredictable manner, resulting in an inconsistent and inefficient motions and thus, inefficient workouts. These modifications are also time-consuming and impractical for a user that wants to quickly alter the weight of a rope.

Different motions are essential to a versatile jump rope exercise regime. For example, many jumping techniques target the upper body by incorporating arm- or hand-crossing movements. When a jump rope is used in such a manner, the design of the attachment point of the rope to the handle is critical. Many jump rope designs, such as U.S. Pat. No. 4,637,606 to Hunn, disclose a jump rope handle with a radial bearing and a plastic member with an exterior recess whereby the rope can be attached using a universal connector. The radial bearing orientation, however, is not optimal for any hand crossing jump rope motions.

Some jump rope devices disclose the addition of mass to the handles of the jump rope device. While the addition of mass to the handles of a jump rope device does have some effect on a workout routine, the addition of mass to the rotating portion of the jump rope device have a much greater impact on resistive forces imparted on the user during a workout. Additionally, increasing mass on the rotating portions (i.e. the rope portion) of a jump rope device allows the jump rope device to be more versatile because resistive forces can be varied by spinning the jump rope faster or slower.

Some jump rope devices, such as U.S. Pat. No. 6,544,148 to Loew, disclose a jump rope wherein the weight of the handles and the weight of the rope can be adjusted via the addition of counterweights at designated areas on the rope. This results in a lack of uniformity in the mass distribution of the rope. Such uneven mass distribution yields an awkward feel and operation, resulting in less efficient workouts and an increased learning curve for novice users.

Although jump ropes have existed for a long time in many various embodiments, there is an emerging mass market for a jump rope that has quickly modified weight characteristics in order to meet a jump rope user's specific workout needs. Some examples of this are very lightweight, fast revolving jump ropes used for speed and quickness exercises and skills. Other jump rope devices utilize heavy ropes for strength-type training. Quality jump ropes that meet these needs tend to be very expensive. For a jump rope user who wants to perform multiple types of jump rope exercises and workouts it can be expensive to purchase multiple jump ropes. An additional problem for consumers is that heavy jump ropes traditionally have been constructed of materials that are prone to breakage, particularly at the mechanical connection between the handle and the rope.

U.S. Pat. No. 8,911,333 to Hunt, the entirety of which is incorporated by reference herein, discloses a jump rope device having a removably-connected cable, thus enabling a single pair of handles to be used with a variety of different cables. The '333 Hunt patent disclosed the use of a snap hook to removably connect the cable to the handle. While the devices disclosed in the '333 Hunt patent provided significant advantages over the prior art, they did suffer from certain limitations. The large gate snaps used for the connection assembly were somewhat bulky and prone to impacting the top of the handle while jumping. The connection assembly disrupted smooth rotation and could cause twists, tangles, and even strike the user on the hand. Furthermore, some users found it difficult to remove the rope from the clasp because of the difficulty in depressing the spring-loaded gate. This difficulty could lead to frustration, scratching of the finger nails and/or nail polish, and excessive rest time during a workout.

U.S. Pat. No. 10,478,655, to Hunt, the entirety of which is incorporated by reference herein, discloses a jump rope device with an improved connection assembly that enabled a user to more quickly and easily attach and detach different cables. While the devices disclosed in the '655 Hunt patent provided significant advantages over the prior art, they did suffer from certain limitations. In particular, the bearing assembly described in the '655 Hunt patent enabled frequent undesired contact between connection linkages and the handle itself, leading to undesirable noises (e.g., "clicking"), less optimal smoothness of rotation, and increased likelihood of a recoiling rope that can painfully strike a user's hand when a jump is missed and the rope goes taut.

Thus, there is a need for a jump rope device having a removably-connected cable with an improved connection assembly.

SUMMARY

According to a first aspect of the invention, there is provided a jump rope device including a handle and a cable. The handle includes a handle grip, a bearing assembly, and a first connecting member. The cable includes a second connecting member. The first and second connecting members are configured to removably connect the cable to the handle. The bearing assembly is configured to allow a bearing post to rotate freely relative to the handle grip about a longitudinal axis defined by the handle grip. The bearing post is connected to the first connecting member via a connecting ring. The bearing post includes an enlarged portion adjacent to an aperture in the bearing post through which the connecting ring passes. The enlarged portion is configured to limit the range of motion of the bearing ring so as to define a minimum angle between a longitudinal axis of the handle and a plane defined by the connecting ring. The minimum angle is sufficiently large to prevent the first connecting member from making contact with any portion of the handle other than the connecting ring.

BRIEF DESCRIPTION OF THE DRAWINGS

FIG. 4B is an end view of the male connecting member of

FIG. 4A.

DETAILED DESCRIPTION

The present disclosure is directed to jump rope devices which allow for the quick and easy interchanging of a cable of varying weight and length from handles configured to provide smooth rotation of such cables at both low and high speeds. Devices in accordance with the disclosure may comprise a ball bearing assembly configured to facilitate 360-degree rotation of the cable.

Jump rope devices in accordance with the present disclosure facilitate a variety of traditional as well as modern jump rope-based exercises. Such exercises include: basic bounce step, the alternate foot step, criss cross, side rope swings, single- and double-leg high knee exercise, double unders, run skipping, and the "Ali shuffle."

Figure 1:
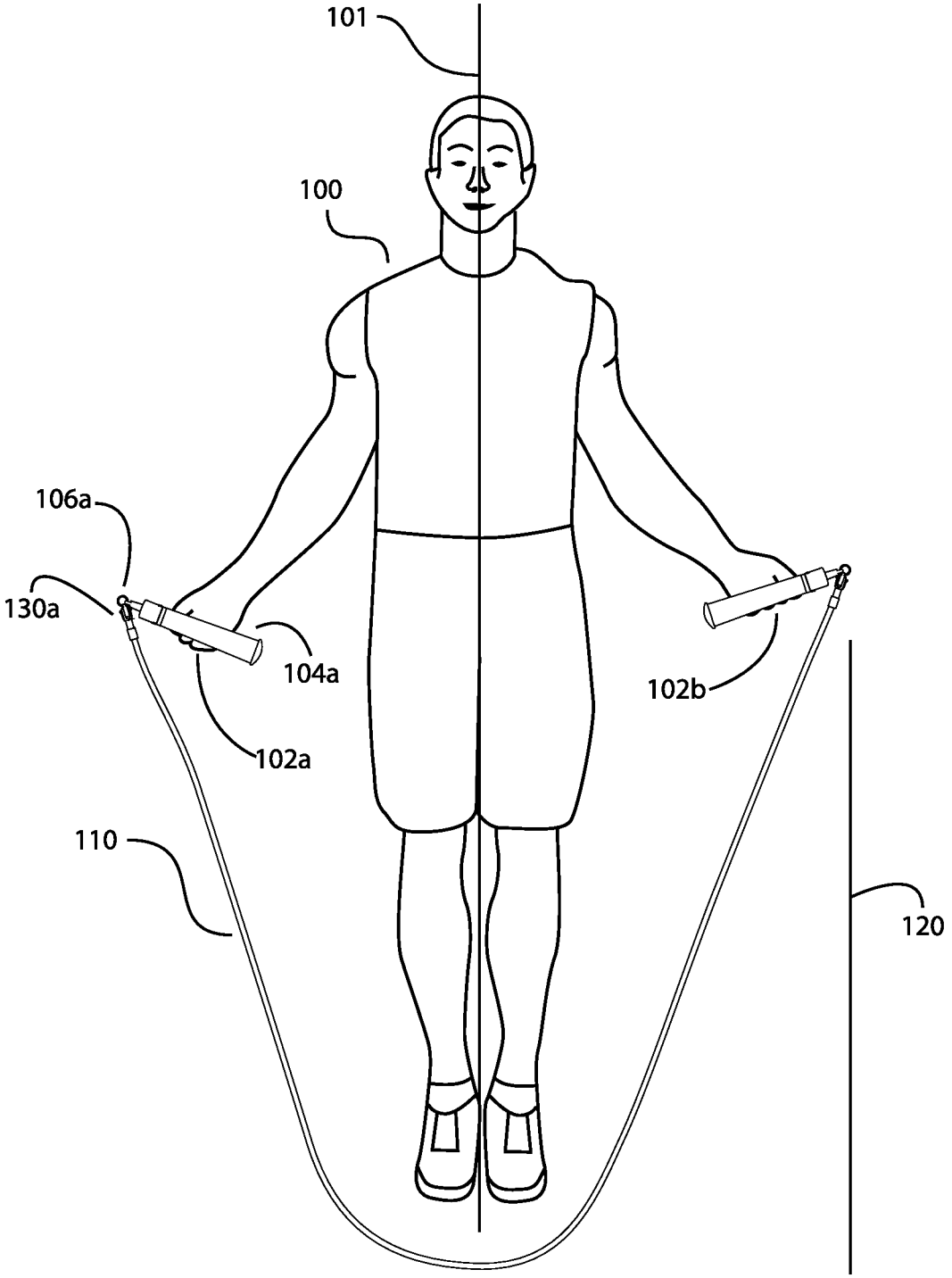
FIG. 1 is a front view of a jump rope device being utilized by a user.

Referring to FIG. 1, a front view of a jump rope 120 being utilized by a user 100.

Hereinafter, an "inner" portion of an element will generally refer to a portion of an element which is closer to the sagittal plane 101 of user 100 when user 100 is utilizing jump rope 120 to perform a basic bounce step, as shown in FIG. 1. Hereinafter, an "outer" portion of an element will generally refer to a portion of an element which is farther away from sagittal plane 101 of user 100 when user 100 is utilizing jump rope 120 to perform a basic bounce step.

Jump rope 120 comprises two handles 102 (i.e., a right handle 102*a* and a left handle 102*b*) and a cable 110. Cables of varying sizes and weights may be used with jump rope devices 120. Varying-sized cables 110 will provide different amounts of centrifugal resistance at equal rotational speeds. Utilization of varied cables 110 strengthens a user's body through adaption to varied stimuli of increased weight and/or resistance. In an aspect, cable 110 may be at least partially constructed from one or more of rope, leather, nylon, pro-vinyl, cloth, braided steel, vinyl coated steel cable, and any other suitable material as will be apparent to those skilled in the relevant art(s) after reading the description herein.

Handles 102 are configured to facilitate user operation of jump rope 120. Handles 102 may comprise handle grips 104 (shown, for clarity, only as handle grip 104*a* in FIG. 1) and handle rotators 106 (shown, for clarity, only as handle rotator 106*a* in FIG. 1). Handles 102 may be comprised of wood, steel, carbon fiber, aluminum, polyvinyl chloride, plastic, thermoplastic elastomer, or any other materials as will be apparent to those skilled in the relevant art(s) after reading the description herein.

Handle grip 104 is configured to allow user 100 to hold jump rope 120 and manipulate cable 110. Handle grip 104 comprises an inner portion and an outer portion. The outer portion of the handle grip may be rigidly connected to handle rotator 106.

Handle rotator 106 is configured to removably connect cable 110 to handle 102. Handle rotator 106 is further configured to facilitate 360-degree rotation of cable 110 relative to handle 102. Handle rotator 106 may be located on an outer portion of handle 102.

Figure 2A:
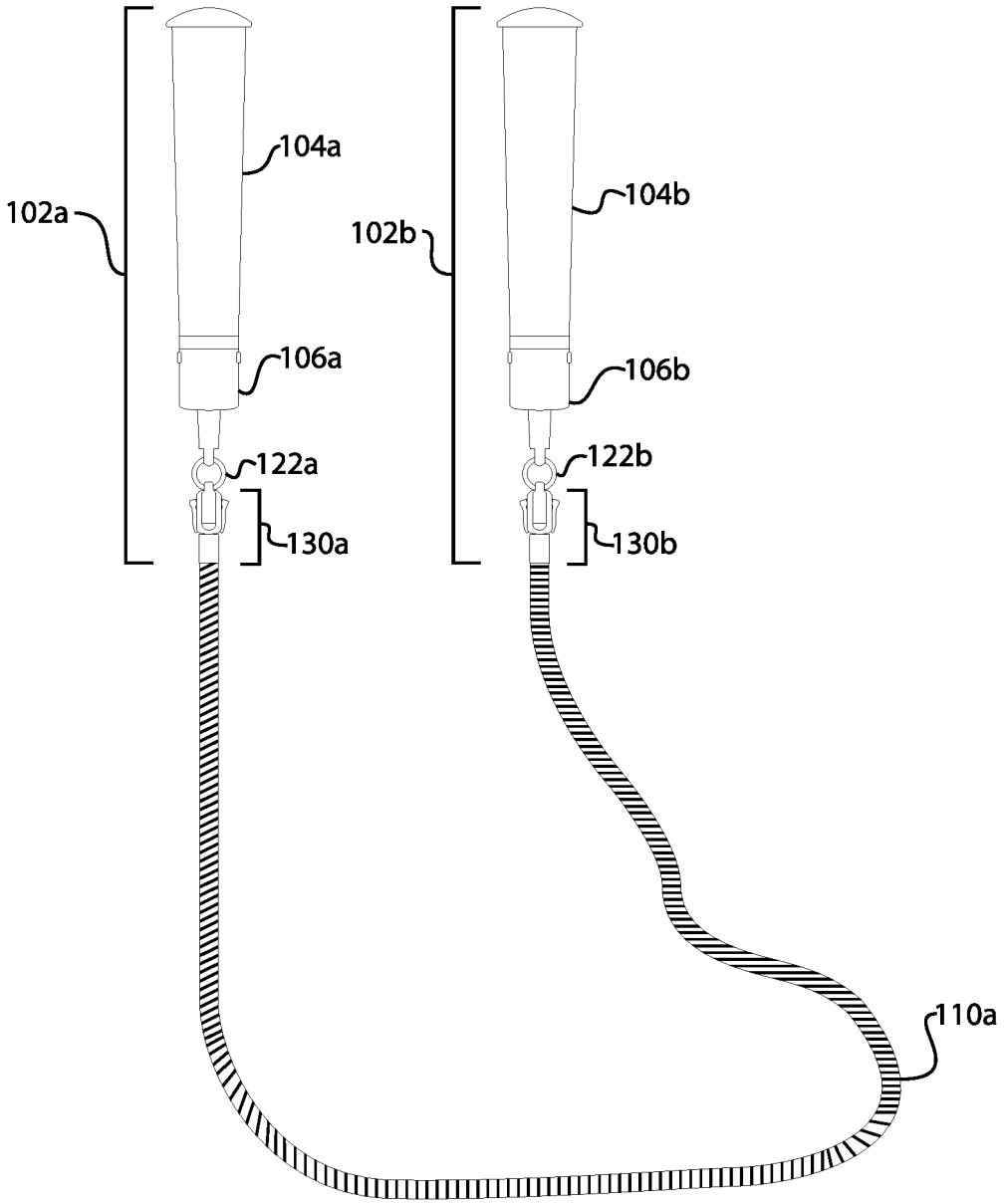
FIGS. 2A and 2B are schematic views of a jump rope device comprising two cables which may be removably connected to the handles.
Figure 2B:
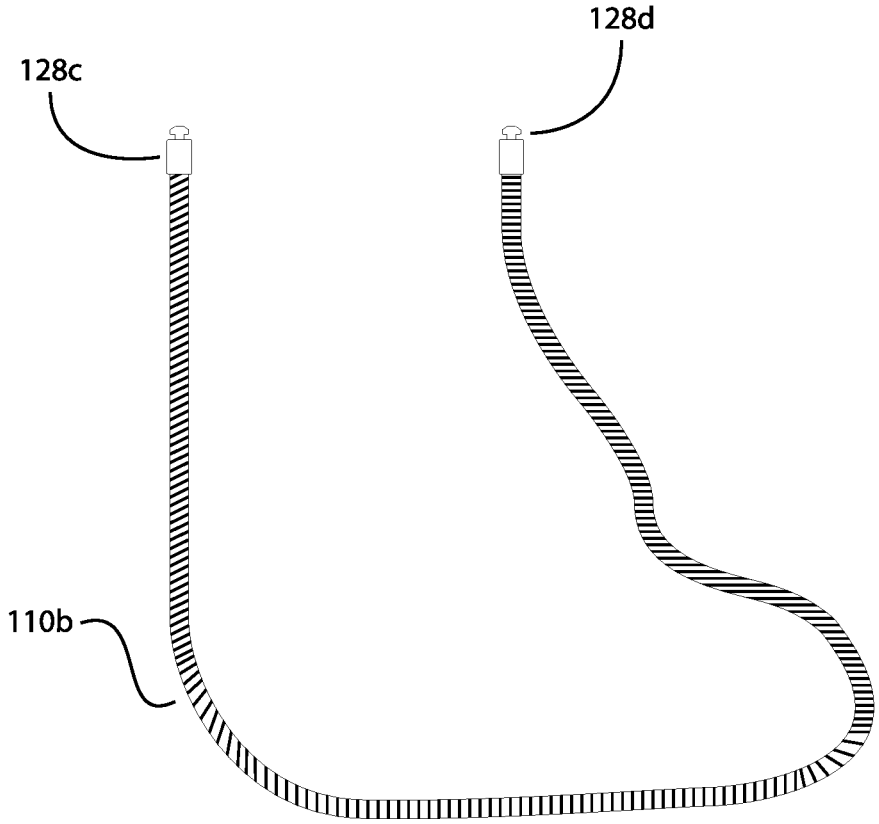

Referring now to FIGS. 2A and 2B, schematic views of a jump rope 120 comprising two cables 110 which may be removably connected to handles 102.

Figure 3:
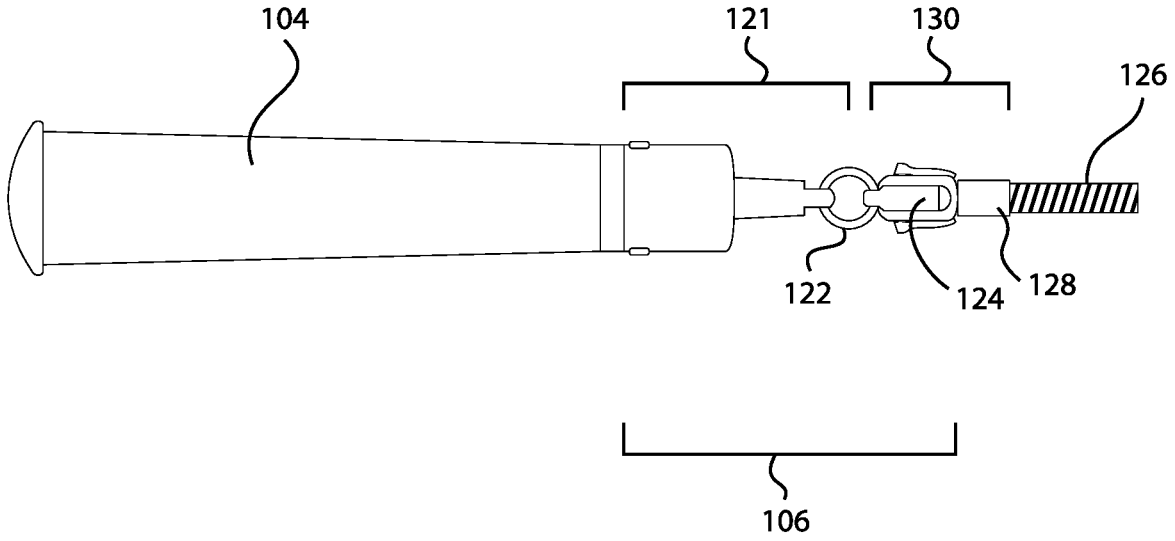
FIG. 3 is a side view of a handle connected to a cable.

Referring now to FIG. 3, handle rotator 106 comprises a bearing assembly 121 and a female connecting member 124. Female connecting member 124 may be connected to bearing assembly 121 via a soldered ring 122 or other suitable connection means. Female connecting member 124 is configured to removably connect handle 102 to cable 110. Cable end portion 126 may comprise a male connecting member 128 configured to insertably and removably connect to female connecting member 124, such that cable 110 may smoothly rotate during operation of jump rope 110. Female connecting member 124 and male connecting member 128 together form a connection assembly 130. Connection assembly 130 is adapted to quickly and easily interchange cables 110 of varying weights and lengths from handles 102.

Figure 4A:
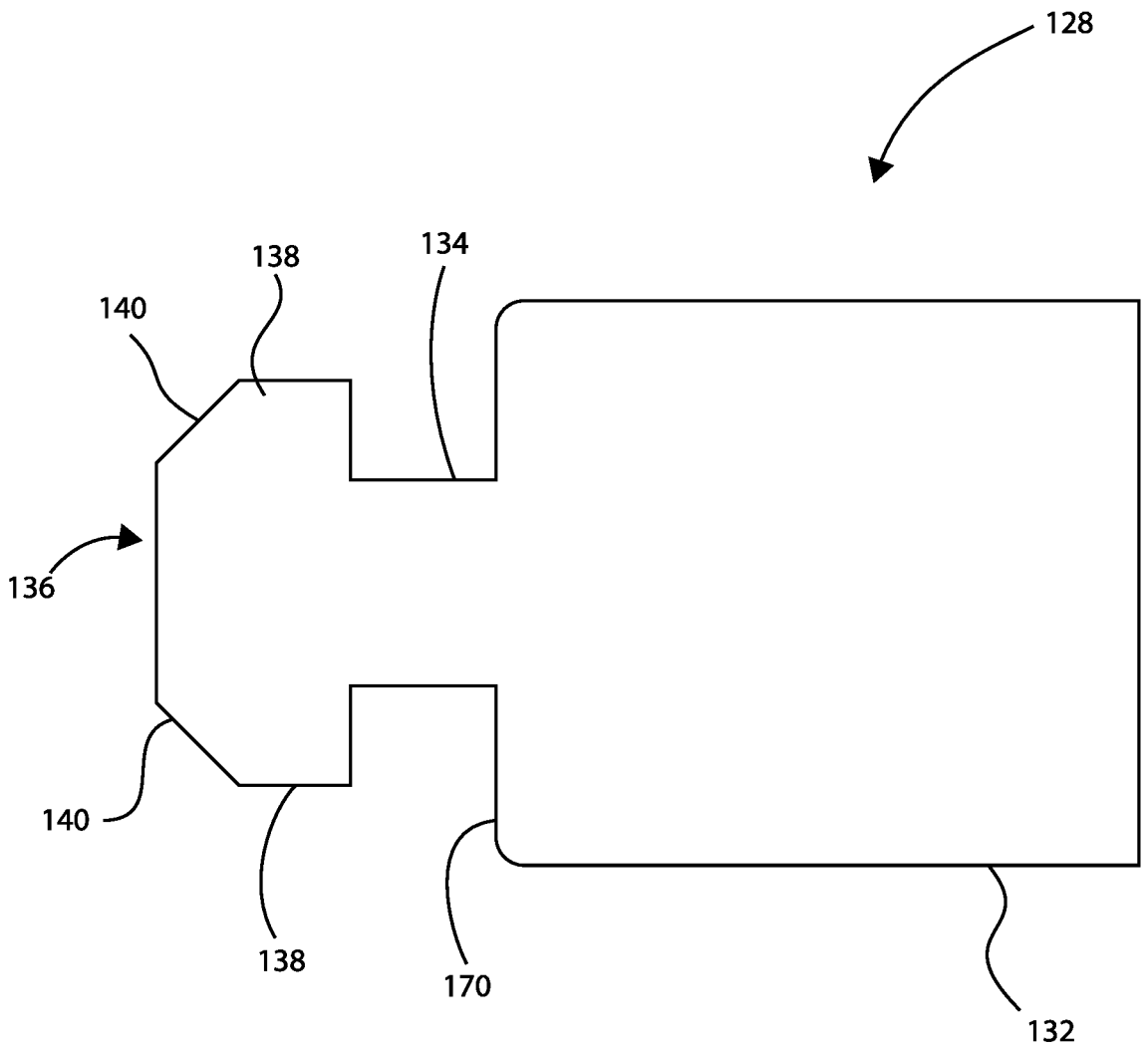
FIG. 4A is a side view of a male connecting member.
Figure 4B:
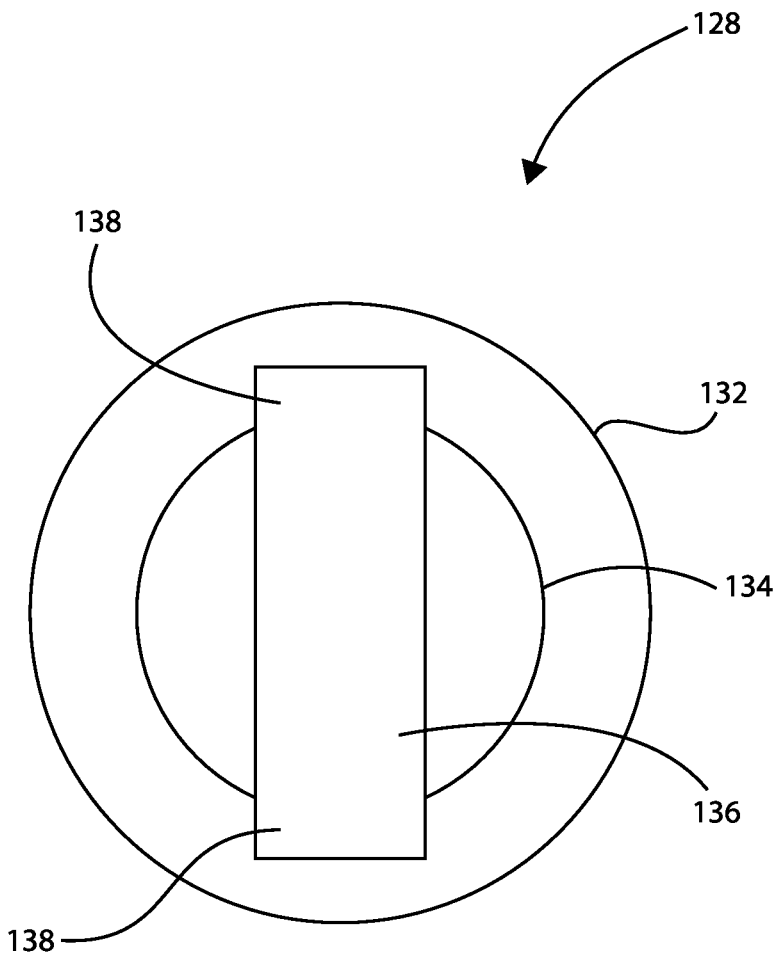

Referring to FIGS. 4A and 4B, male connecting member 128 includes a base 132. Base 132 can be generally cylindrical in shape. Base 132 can be fixedly attached to cable end portion 126 via mechanical crimping of base 132 onto cable 110 or via other suitable attachment means. Male connecting member 128 further includes a neck portion 134. Neck portion 134 can be generally cylindrical in shape and can have a reduced diameter as compared with base 132. Neck portion 134 is disposed between and connects base 132 and a locking head portion 136 of male connecting member 128. Locking head portion 136 can have an elongated, generally-rectangular box shape. First and second end portions of locking head portion 136 define first and second locking projections 138 that extend radially outwardly beyond the diameter of neck portion 138. Locking projections 138 may include chamfered corners defining leading angled surfaces 140.

Figure 5A:
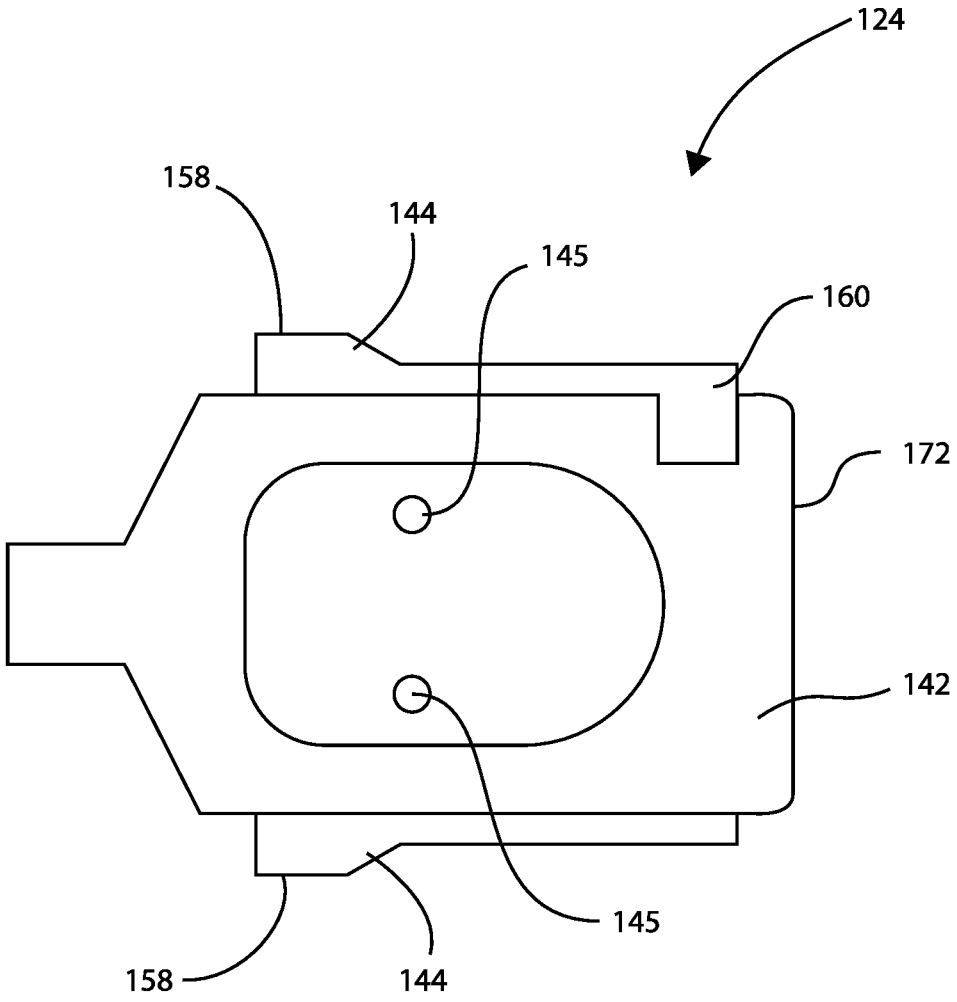
FIG. 5A is a first side view of a female connecting member.
Figure 5B:
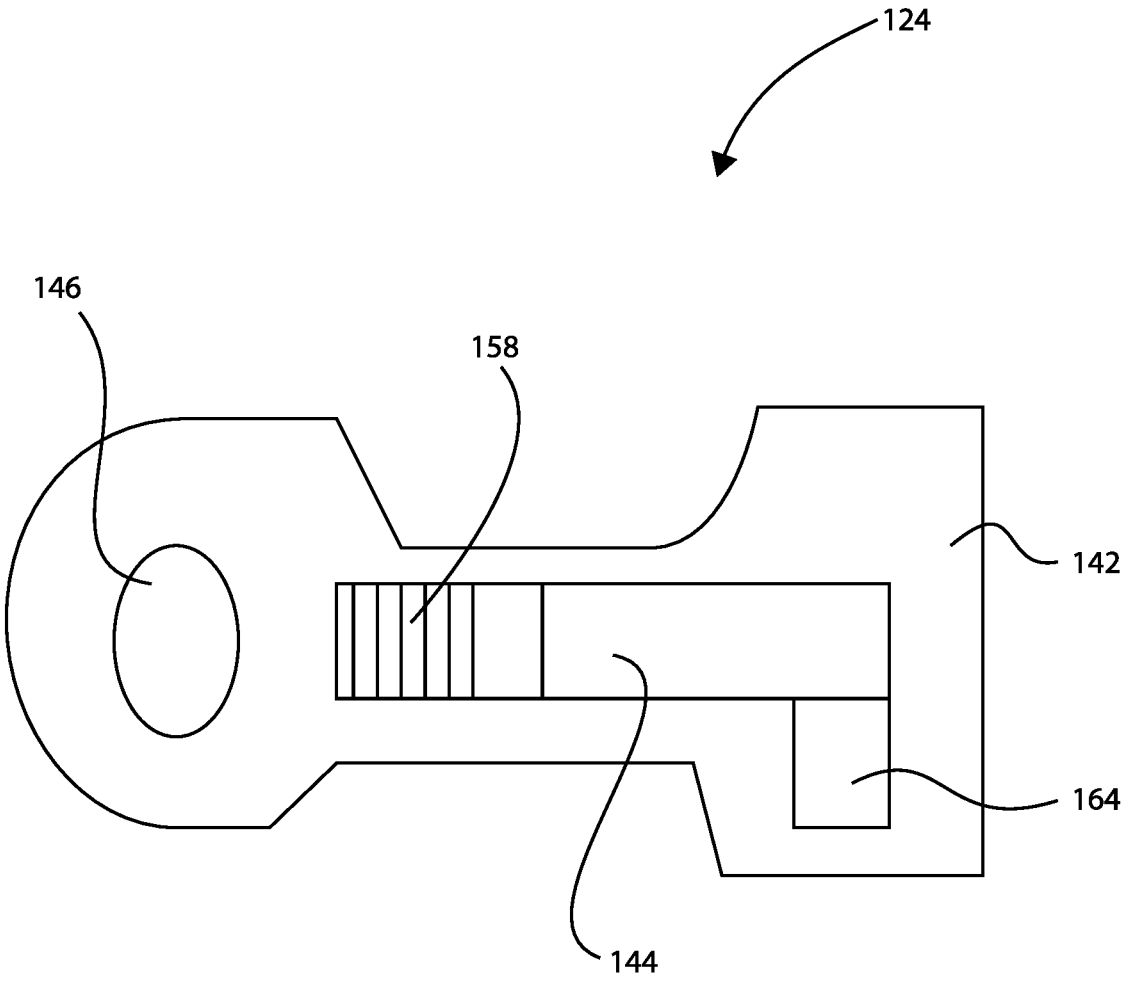
FIG. 5B is a second side view of the female connecting member of FIG. 5A, rotated 90 degrees with respect to the view of FIG. 5A.
Figure 5C:
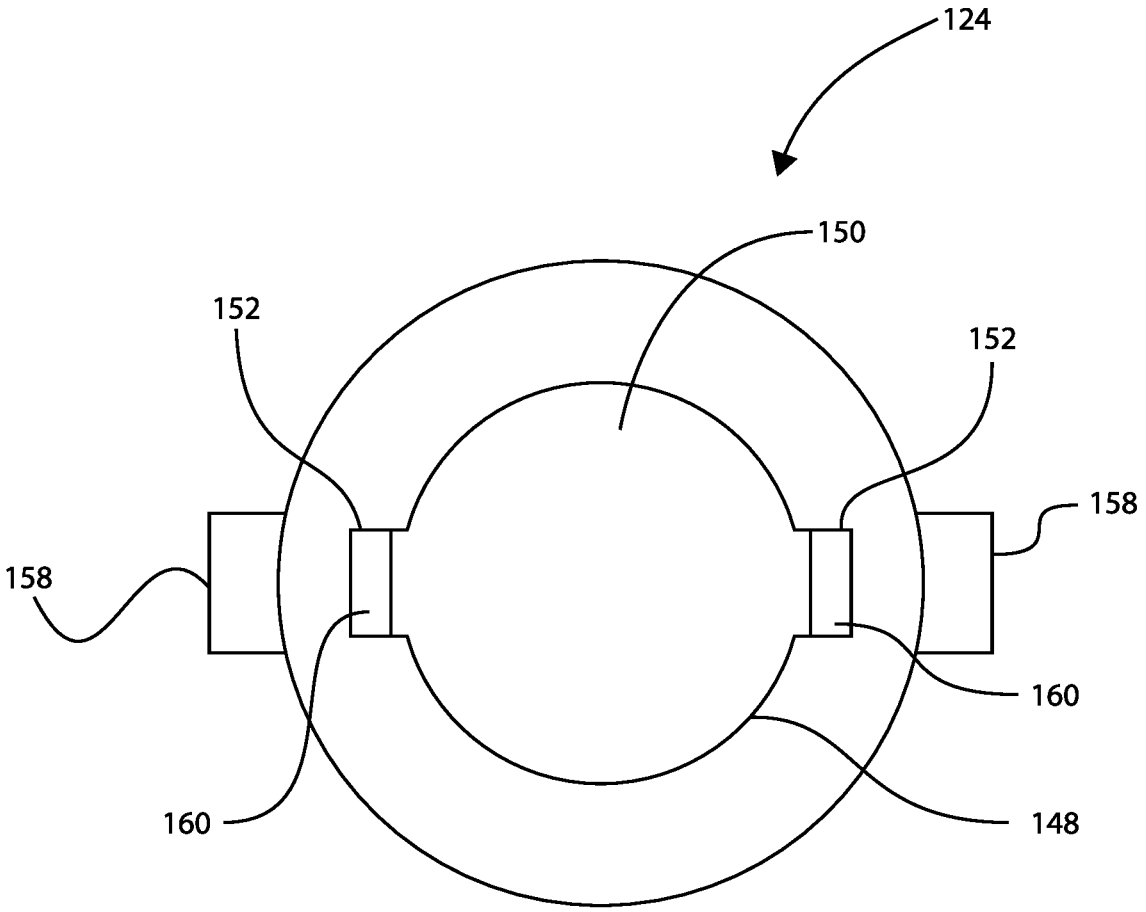
FIG. 5C is an end view of the female connecting member of FIG. 5A.
Figure 5D:
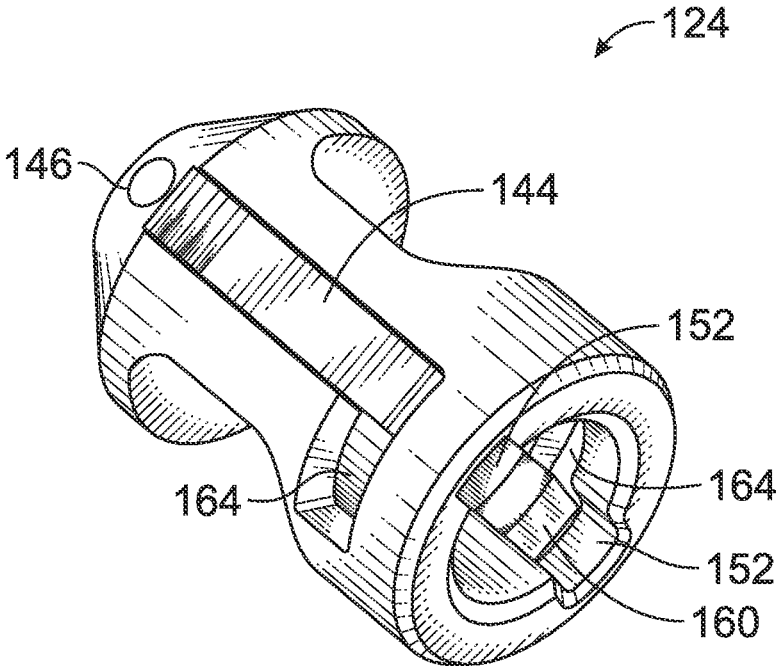
FIG. 5D is a perspective view of the female connecting member of FIG. 5A.
Figure 6:
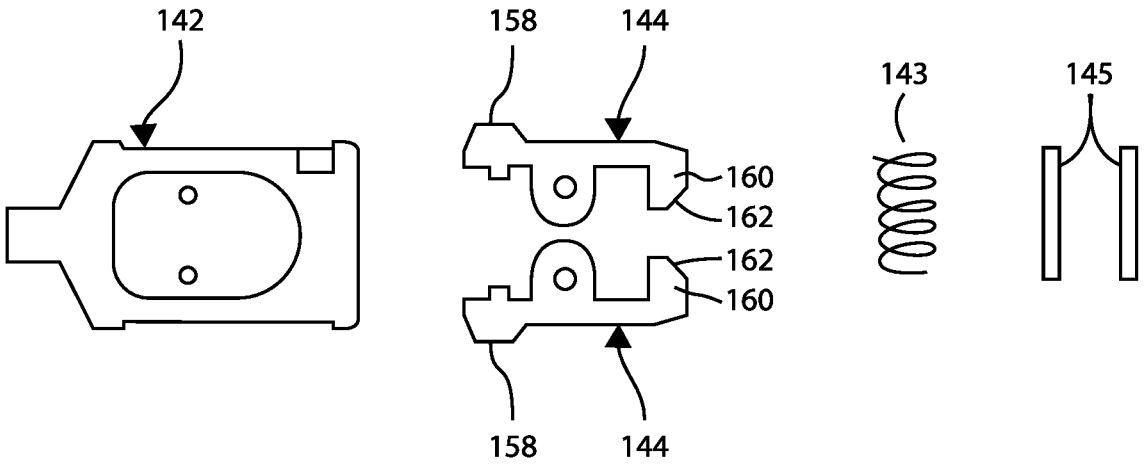
FIG. 6 is an exploded view of the female connecting member of FIG. 5A, showing the individual components from which it can be assembled.
Figure 7A:
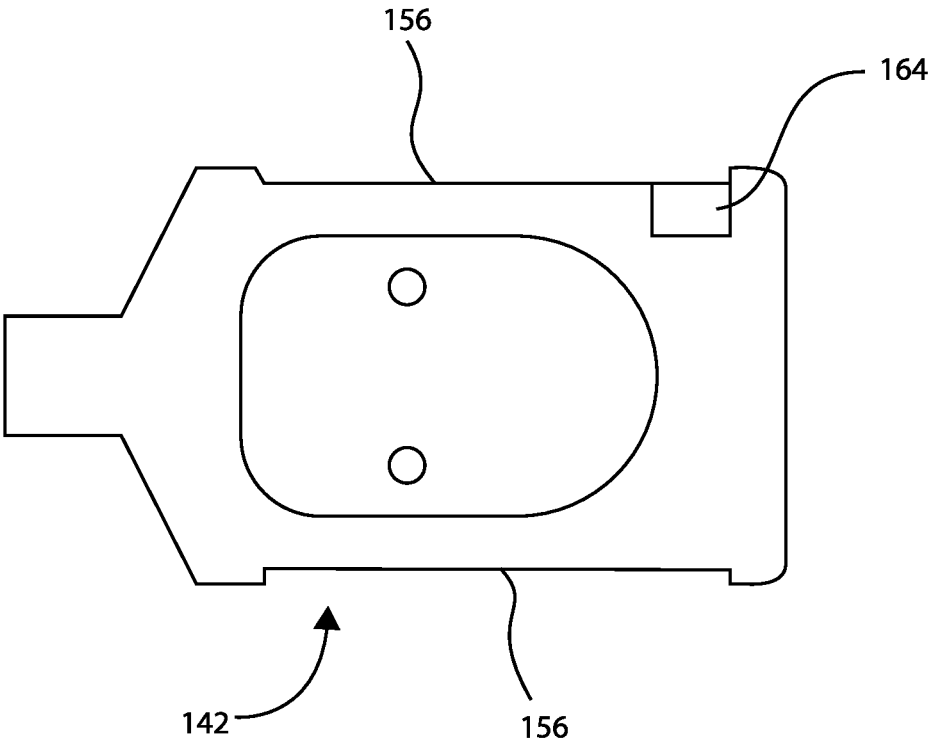
FIG. 7A is a first side view of the base of the female connecting member shown in FIG. 6.
Figure 7B:
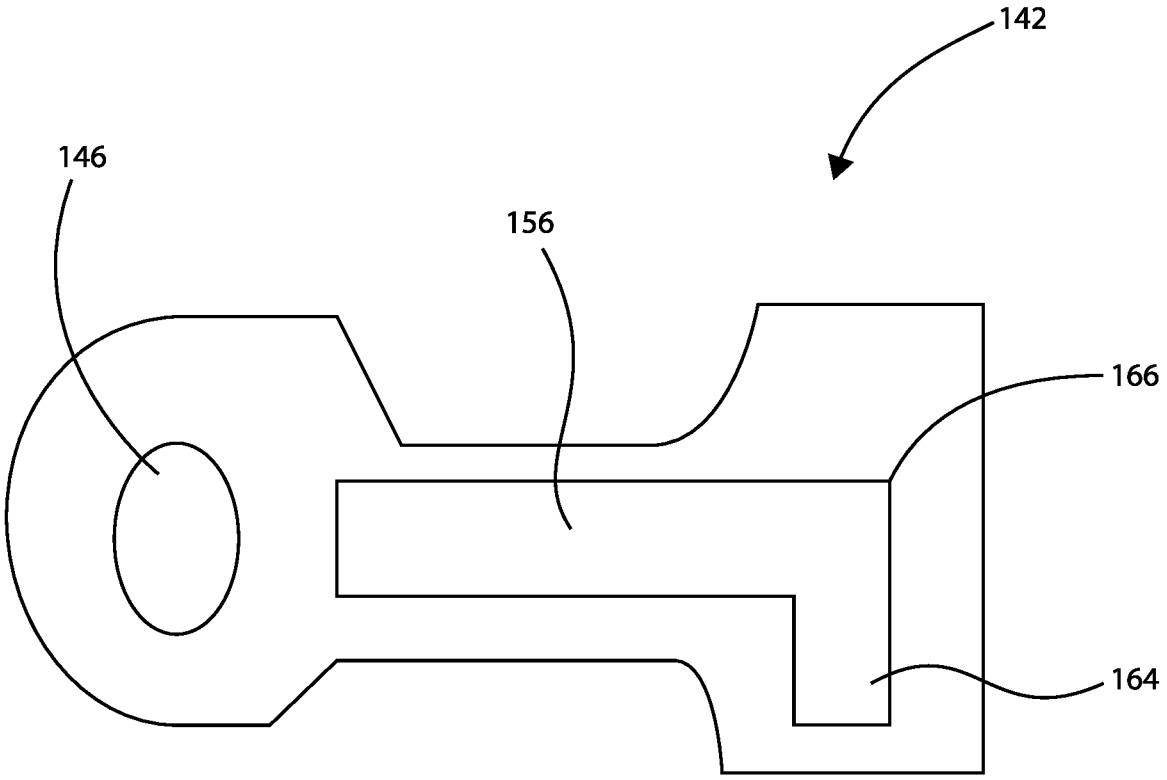
FIG. 7B is a second side view of the female connecting member base of FIG. 7A, rotated 90 degrees with respect to the view of FIG. 7A.
Figure 7C:
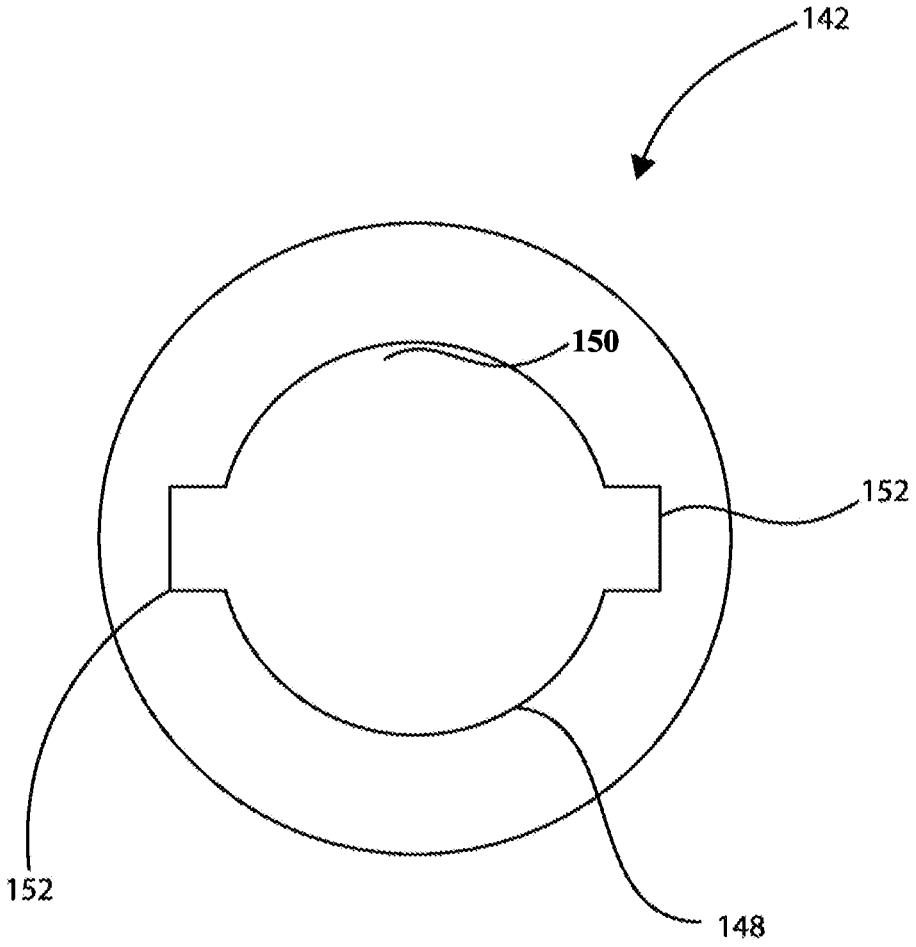
FIG. 7C is an end view of the female connecting member base of FIG. 7A.

Referring to FIGS. 5A-5C, female connecting member 124 includes a base 142 and two spring-biased locking arms 144. FIG. 6 shows an exploded view of the components that can be combined to form female connecting member 124, including base 142, locking arms 144, spring 143, and pivot pins 145. Base 142 can have a generally cylindrical shape. FIGS. 7A-7C show various views of base 142. Inner end of base 142 can include an opening 146 through which soldered ring 122 can be received. Opening 146 can be made by an eyelet, a bore, an eyehook, or other equivalent. Outer end of base 142 defines an opening 148 into an internal cavity 150. Opening 148 includes a central circular portion dimensioned and arranged so as to receive neck portion 134 when male connecting member 128 is received within female connecting member 124. Opening 148 further includes notched portions 152 dimensioned and arranged so as to receive first and second locking projections 138 when male connecting member 128 is received within female connecting member 124.

Figure 8A:
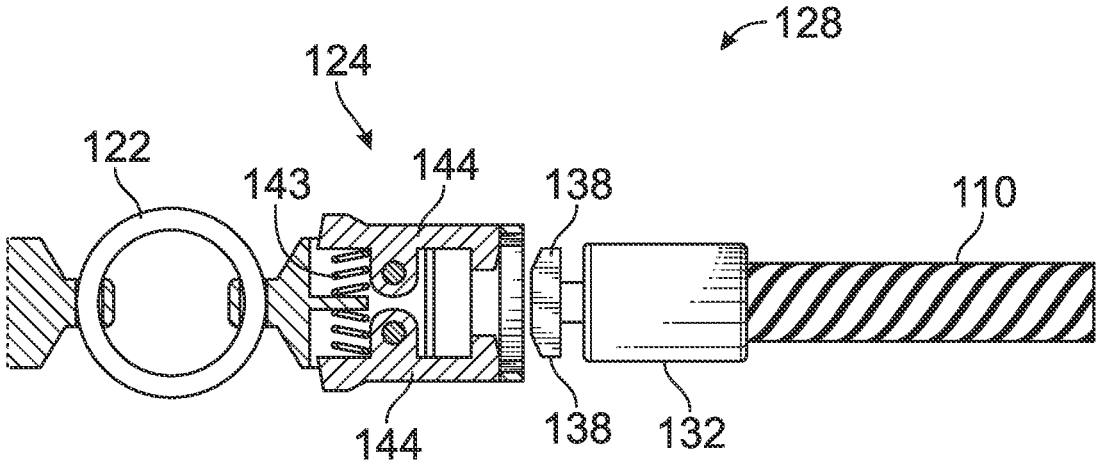
FIGS. 8A-8C show various steps involved in connecting the male connecting member of FIG. 4A to the female connecting member of FIG. 5A.

Spring-biased locking arms 144 are disposed within respective channels 156 (see FIG. 7B) running longitudinally along opposite sides of the base 142. Locking arms 144 are pivotally connected to base 142 via pivot pins 145. Each locking arm 145 includes a raised gripping portion 158. Gripping portion 158 may have a textured surface to facilitate gripping by a user. Locking arms 144 are biased by internal spring 143 into a first position as shown in FIG. 8A. In the first position, an end portion 160 of each locking arm 144 extends at least partially into the cavity 150. Locking arms 144 are aligned with respective notches 152 such that each locking arm 144 is positioned in a portion of the cavity 150 located above a respective notch 152 when in the first position. Each end portion 160 can have an angled leading surface 162 that is substantially complementary to a corresponding angled surface 140 of male locking member 128. Apertures 164 that are contiguous with the channels 156 and adjacent to end portions 160 extend through the exterior surface of base 142 and into the internal cavity 150. Apertures 164 each define a lower ledge surface 166.

Figure 8B:
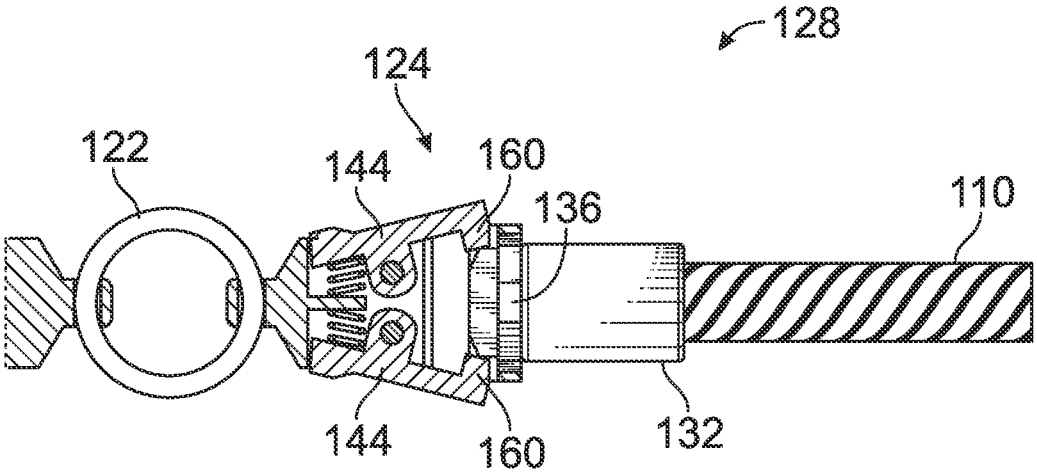
Figure 8C:
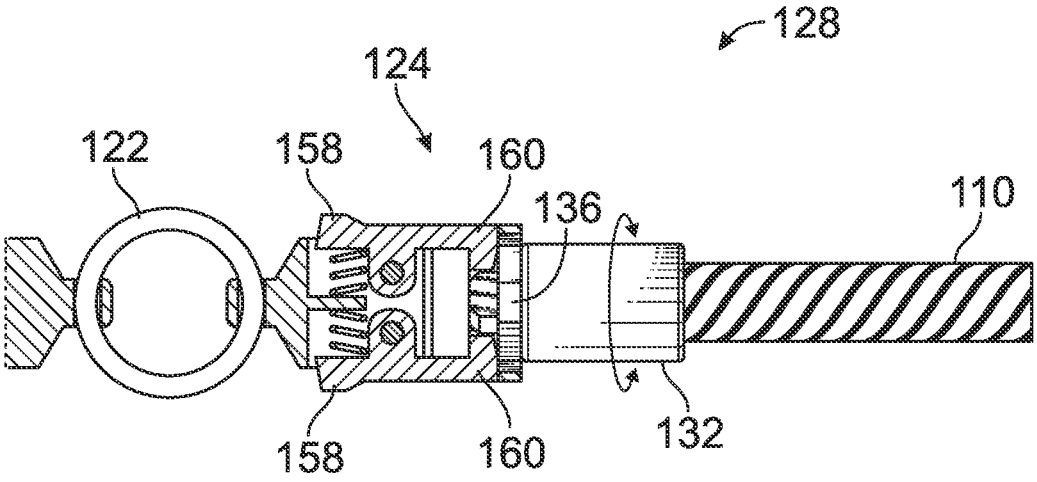

FIGS. 8A-8C depict steps by which cable 110 can be securely connected to handle 102. Portions of the female connecting member 124 are shown as transparent to facilitate viewing of various internal components. To connect the cable 110 to the handle 102, a user can grasp the male connecting member 128 in one hand and the female connecting member 124 in the other. The user aligns locking projections 138 of the male connecting member 128 with the notches 152 and inserts the male connecting member 128 into the opening 148. This motion brings locking projections 138 into contact with end portions 162, and more specifically leading angled surfaces 140 into contact with leading angled surfaces 162, forcing end portions 160 to move radially outward as locking arms 144 pivot about pivot pins 145 and compressing spring 143. This brings locking arms 144 into a second position as shown in FIG. 8B and allows male connecting member 128 to be fully inserted into the female connecting member 124, bringing the respective end surfaces 170, 172 of base 128 and base 124 into face-contacting relationship. The user then rotates male locking member 128 about its longitudinal axis relative to female connecting member 124, causing locking projections 138 to move into apertures 164 and out of contact with end portions 160. This movement allows end portions 160 to be biased back into the first position by spring 143, thereby locking the male connecting member 128 into a secure connection with female connecting member 124 as shown in FIG. 8C. Ledge surfaces 166 catch locking projections 138 and prevent male locking member 128 from simply being withdrawn from female connecting member 124.

To remove the cable 110 from handle 102, a user uses two fingers to pinch down on the gripping portions 158 of the two locking arms 144. This motion compresses spring 143 and moves locking arms 144 into the second position. While keeping the gripping portions 158 depressed, the user rotates the male connecting member 128 relative to female connecting member 124 until the locking projections 138 are aligned with notches 152 and then withdraws the male connecting member 128 from the opening 148 to fully remove cable 110 from handle 102.

The connection assembly 130 described herein may provide significant advantages over prior art approaches. Connection assembly 130 can be shorter and smaller so that it integrates directly with the rope, having less bulky, moving parts that can twist and tangle, and thereby enabling smoother unencumbered rotation. Connection assembly 130 can also be much easier for the average user to attach and detach cables, reducing frustration and unnecessary rest time and making it easier than ever to adjust rope resistance very quickly.

Figure 9:
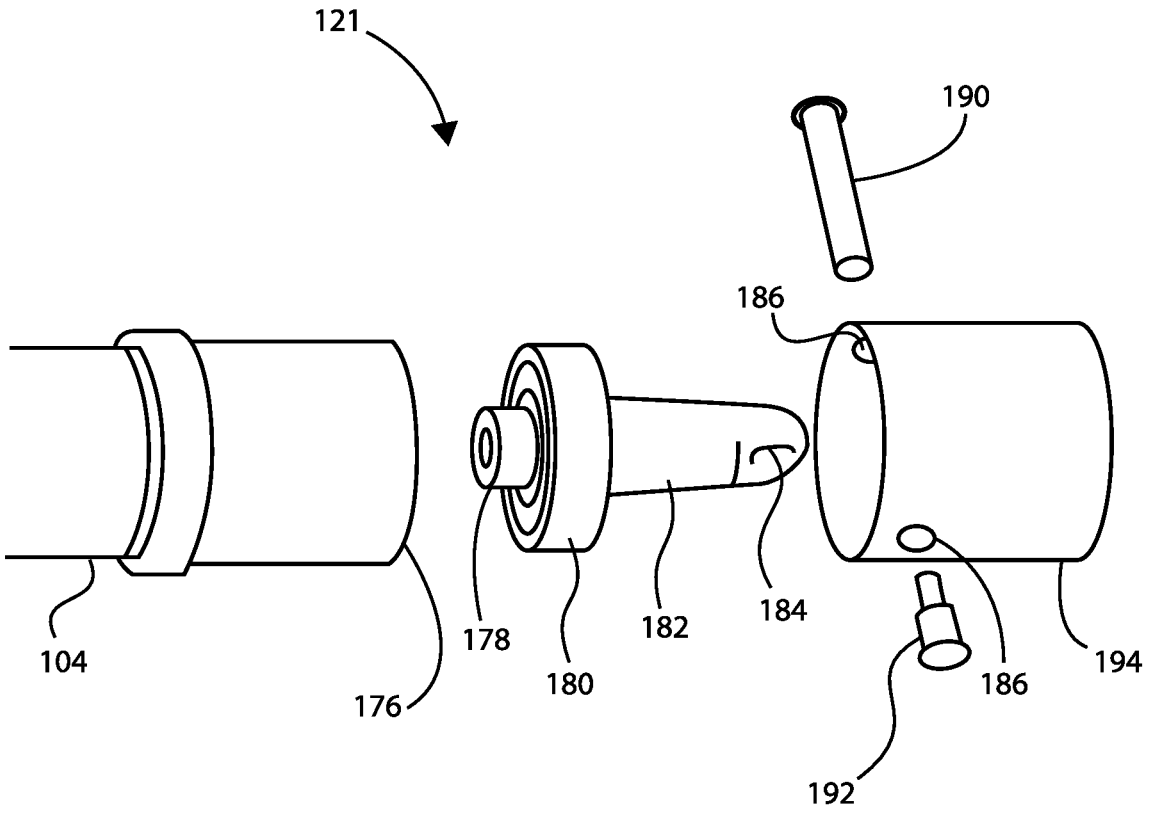
FIG. 9 is an exploded view of a bearing assembly in accordance with one aspect of the present disclosure.
Figure 10:
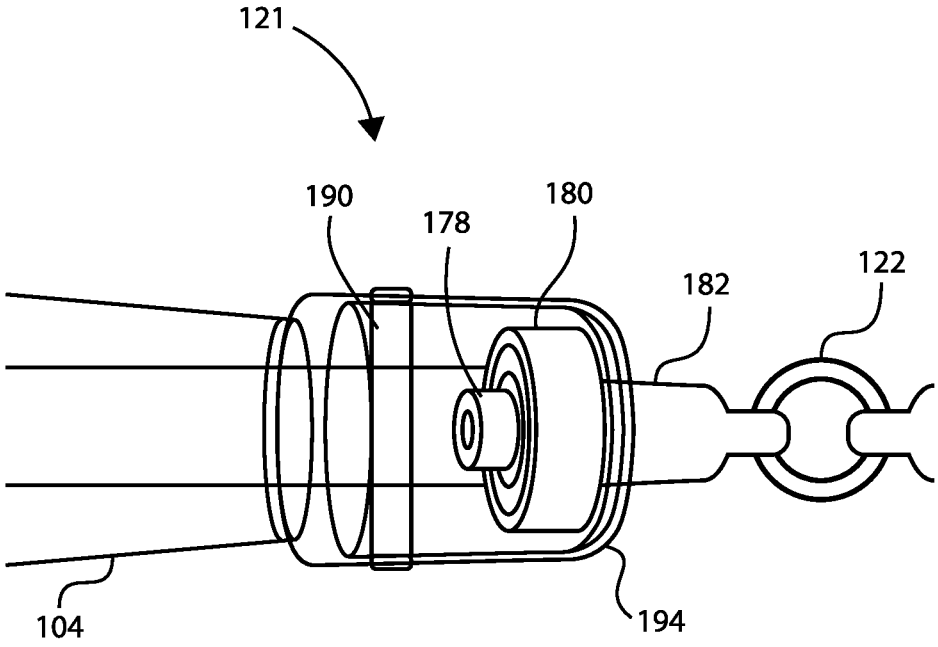
FIG. 10 is a side view of the assembled bearing assembly of FIG. 9.

With reference to FIGS. 9 and 10, one example of a bearing assembly 121 that can be used in accordance with jump rope device 120 is shown. Bearing assembly 121 includes a ball bearing housing 180 that may contain, e.g., ceramic bearings. Ball bearing housing 180 is mounted on a bearing post 182 that includes an opening or eyelet 184 that receives soldered ring 122. A lower portion of bearing post 182 includes a bearing post screw 178. Bearing post screw 178 is secured to bearing post 182 to hold the bearing post flushly and securely on the ball bearing housing 180 and prevent the bearing post from becoming separated from the handle 102. Bearing inset compartment 176 is integral to the outer end of handle grip 104. Bearing cap 194 is fitted over the bearing assembly. Rivet 190 and rivet pin 194 are received through respective holes 186 in the bearing cap 194 and respective holes (not shown) in the bearing inset compartment 176 to secure the bearing assembly 121 in place.

Figure 11:
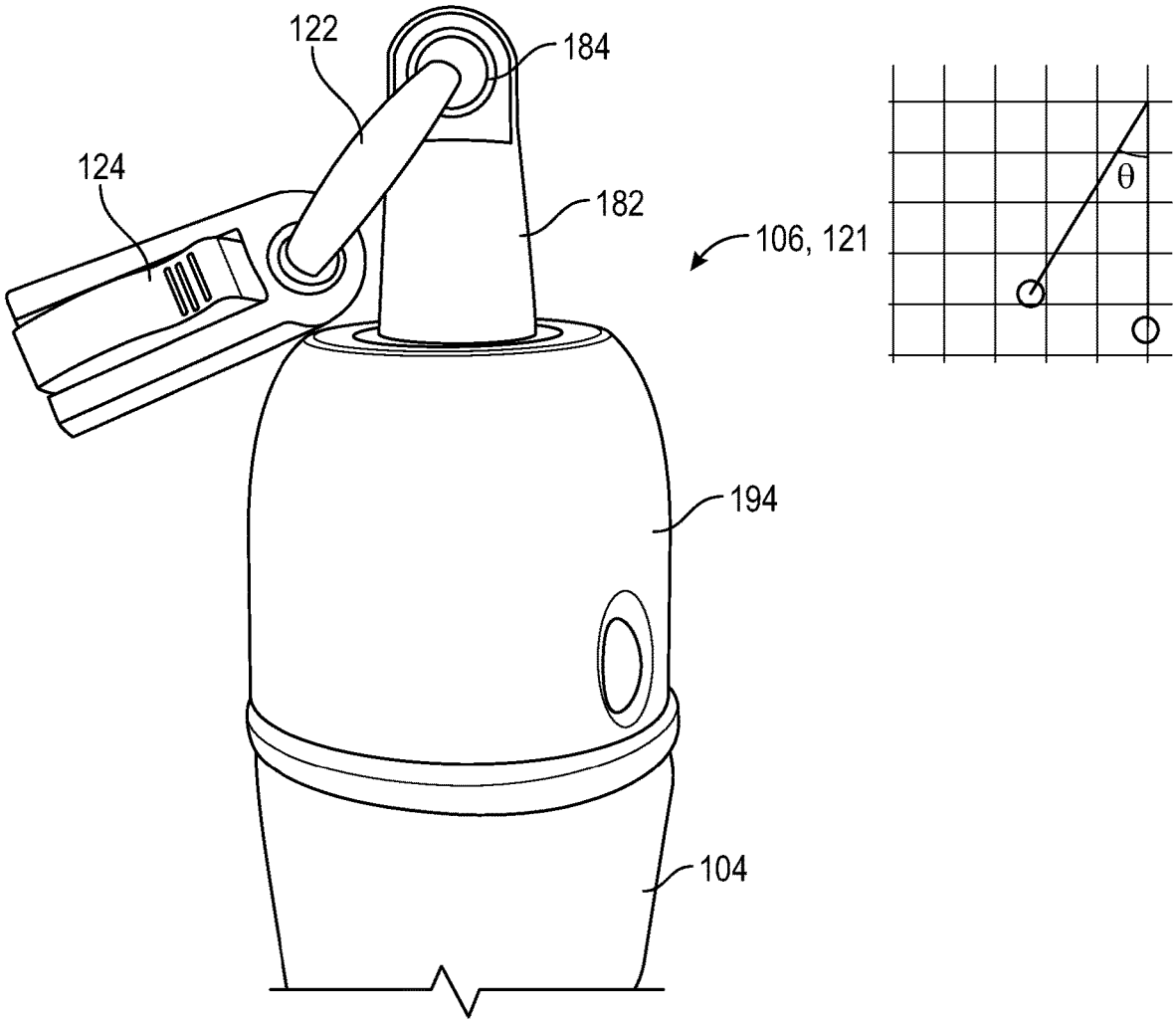
FIG. 11 is another side view of the assembled bearing assembly of FIG. 9, illustrating how the bearing assembly allows the female connection member to make contact with the bearing cap.

As can be seen in FIG. 11, bearing assembly 121 enables nearly-complete rotational freedom of movement of ring 122 such that the minimum possible angle θ between a longitudinal axis defined by bearing post 182 (and handle grip 104) and a plane defined by bearing ring 122 is only approximately 30 degrees. Thus, bearing assembly 121 provides ring 122 with approximately 300 degrees of rotational freedom about an axis that passes through eyelet 184 and is orthogonal to the handle's longitudinal axis. Disadvantageously, this configuration enables frequent and undesired contact between female connecting member 124 and end cap 194, resulting in undesirable "clicking" noises, reduced rotational smoothness, and the increased likelihood of a recoiling rope that can painfully strike a user's hand when a jump is missed and the rope goes taut.

Figure 12A:
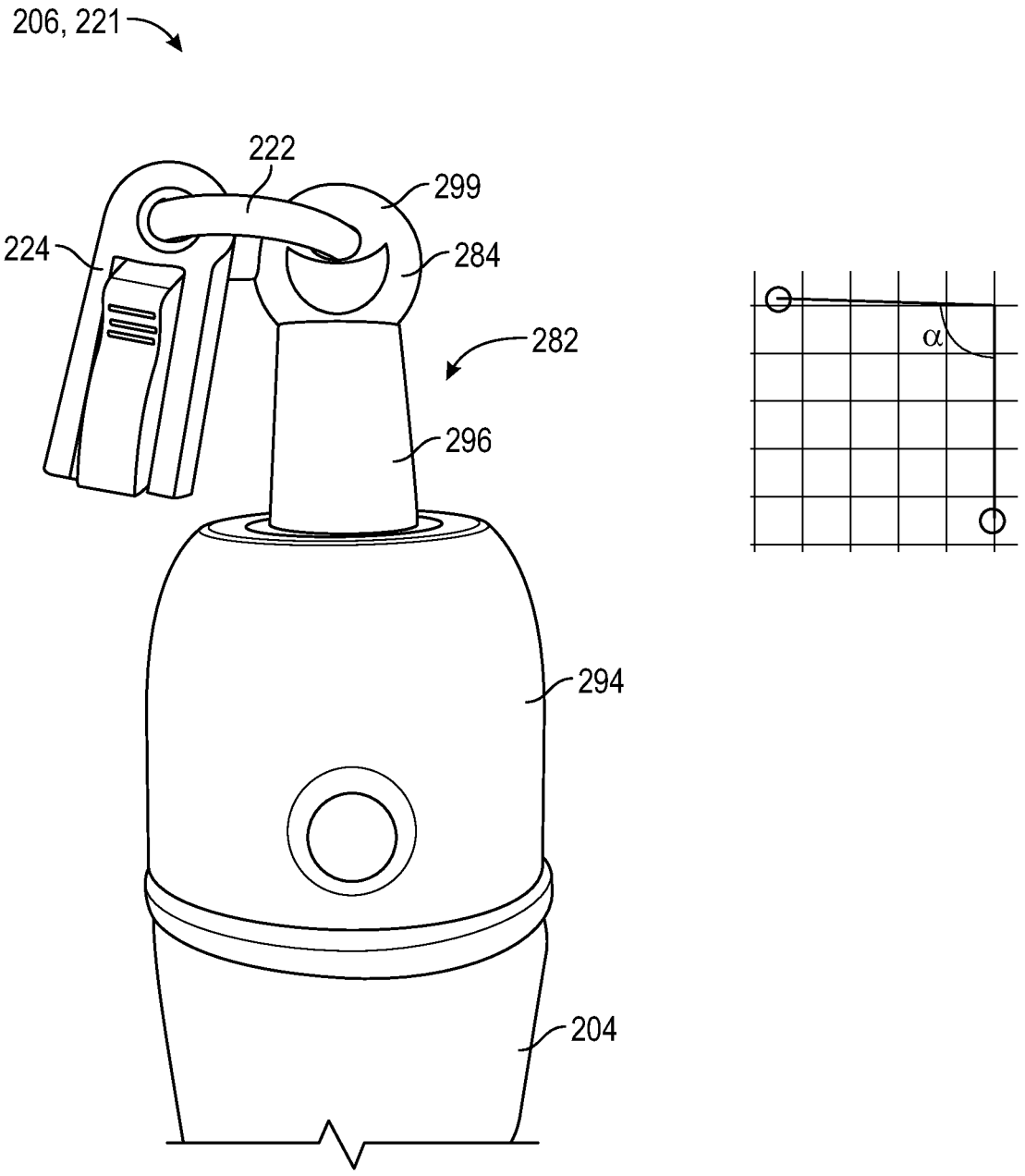
FIG. 12*a* is a side view of an improved bearing assembly in accordance with one aspect of the present disclosure.
Figure 12B:
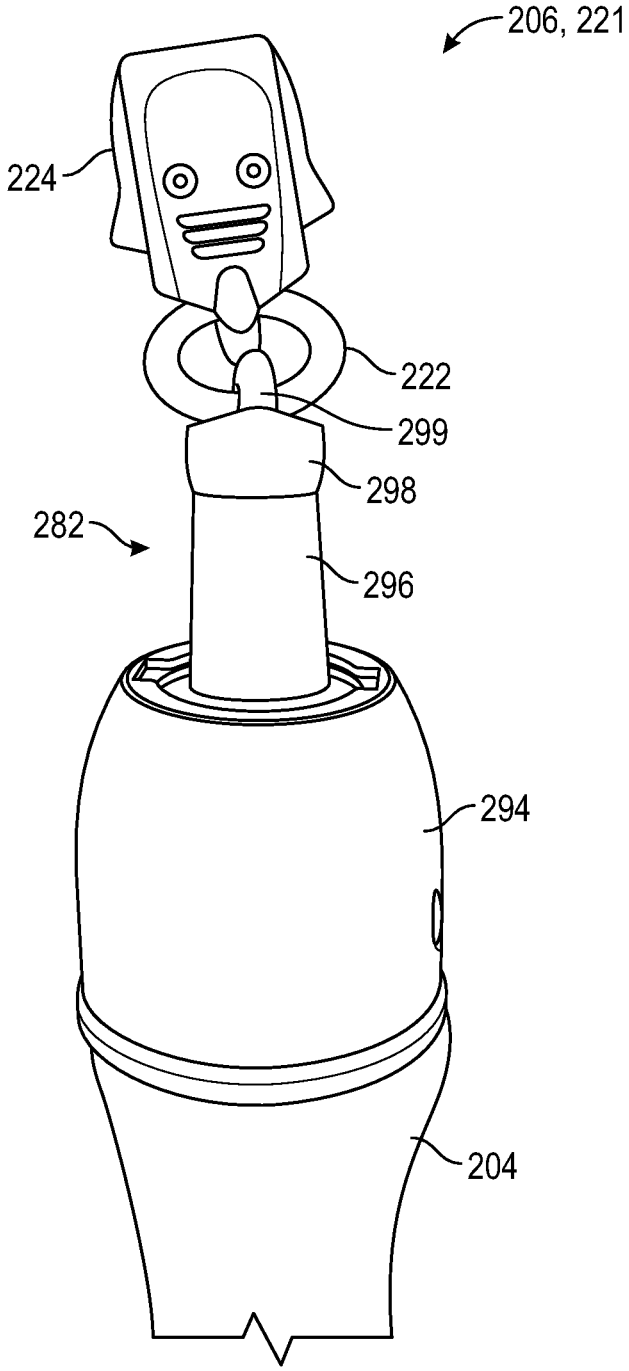
FIG. 12*b* is a side view of the bearing assembly of FIG. 12*a*, in which the bearing post of the bearing assembly has been rotated 90 degrees with respect to its orientation in FIG. 12*a*.
Figure 12C:
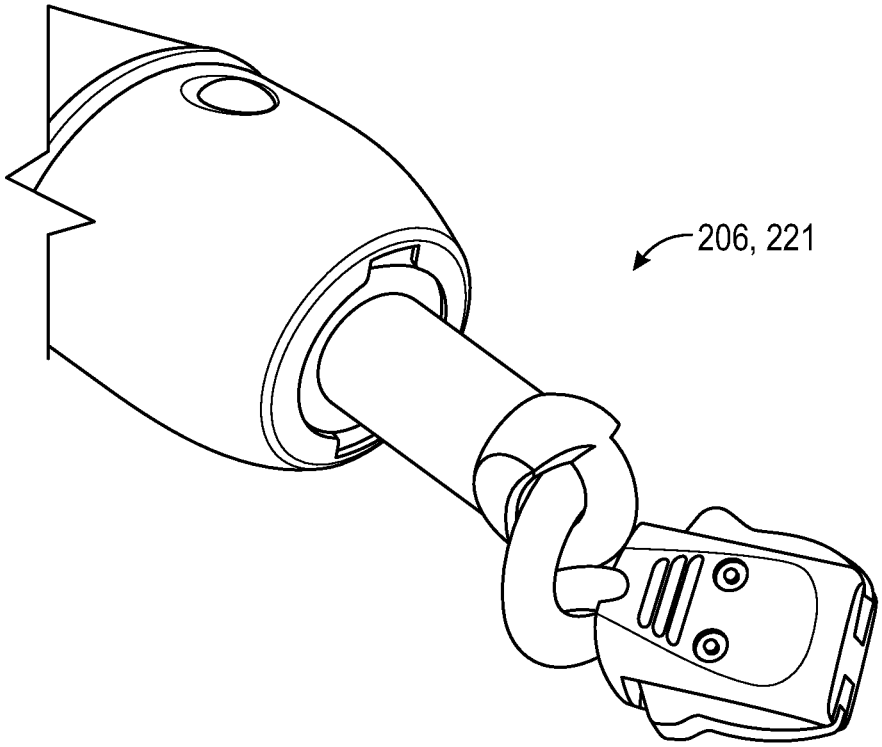
FIG. 12*c* is a perspective view of the bearing assembly of FIG. 12*a*.

FIGS. 12*a*-12*c* depict an improved bearing assembly 221 according to one aspect of the present disclosure. Bearing assembly 221 is similar in certain respects to bearing assembly 121 and like or similar reference numerals may indicate like or similar elements in the Figures. The primary difference between bearing assembly 221 and bearing assembly 121 relates to their respective bearing posts 282, 182. Bearing post 282 has an enlarged platform-style base portion 298, that is immediately adjacent to, and defines in part, eyelet 284, and that prevents excess and unneeded range of motion for connecting ring 222. Bearing post 282 also includes a narrow portion 299 about which ring 222 can move freely. As a result of this configuration, the minimum possible angle α between a longitudinal axis defined by bearing post 282 (and handle grip 204) and a plane defined by bearing ring 222 may be at least about 60 degrees. In a preferred embodiment, and as depicted in FIGS. 12*a*-12*c*, the minimum possible angle α may be at least about 90 degrees. In such an embodiment, bearing ring 222 is provided with no more than about 180 degrees of rotational freedom about an axis that passes through eyelet 284 and is orthogonal to the handle's longitudinal axis. In a preferred embodiment, bearing assembly 221 is configured such that female connecting member 224 cannot make any physical contact with end cap 294 or any other portion of the handle (other than bearing ring 222 to which it is directly attached).

While various aspects of the present disclosure have been described above, it should be understood that they have been presented by way of example and not limitation. It will be apparent to persons skilled in the relevant art(s) that various changes in form and detail can be made without departing from the spirit and scope of the present disclosure. The present disclosure should not be limited by any of the above described aspects, but should not be limited by any of the above described aspects, but should be defined only in accordance with the following claims and their equivalents.

In addition, it should be understood that the figures, which highlight the structure, methodology, functionality and advantages of the present disclosure, are presented as examples only. The present disclosure is sufficiently flexible and configurable, such that it may be implemented in ways other than that shown in the accompanying figures.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

What is claimed is:

1. A jump rope device, comprising:

a handle comprising a handle grip, a bearing assembly, and a first connecting member; and a cable comprising a second connecting member;

wherein the first and second connecting members are configured to removably connect the cable to the handle;

wherein the bearing assembly comprises a bearing post and wherein the bearing assembly is configured to allow the bearing post to rotate freely relative to the handle grip about a longitudinal axis defined by the handle grip;

wherein the bearing post is connected to the first connecting member via a connecting ring;

wherein the bearing post comprises an enlarged portion adjacent to an aperture in the bearing post through which the connecting ring passes, the enlarged portion being configured to limit the range of motion of the connecting ring so as to define a minimum angle between a longitudinal axis of the handle and a plane defined by the connecting ring, said minimum angle being sufficiently large to prevent the first connecting member from making contact with any portion of the handle other than the connecting ring.

2. The jump rope device according to claim 1, wherein said minimum angle is at least about 60 degrees.

3. The jump rope device according to claim 1, wherein said minimum angle is at least about 90 degrees.

* * * * *